US006224279B1

(12) United States Patent
Nielsen et al.

(10) Patent No.: US 6,224,279 B1
(45) Date of Patent: May 1, 2001

(54) KEYBOARD HAVING INTEGRALLY MOLDED KEYSWITCH BASE

(75) Inventors: Kennard E. Nielsen, Redmond; John M. Lutian, Bellevue; R. Thomas Gibbons, II, Seattle, all of WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/318,083

(22) Filed: May 25, 1999

(51) Int. Cl.[7] ..... B41J 5/16; H01H 13/705

(52) U.S. Cl. ..... 400/495; 400/490; 200/345; 200/517

(58) Field of Search ..... 400/472, 479, 400/479.1, 479.2, 488, 489, 490, 495, 691, 693; 200/345, 517; 235/145 R

(56) References Cited

U.S. PATENT DOCUMENTS 5,343,006 * 8/1994 Moffett ..... 200/345
5,442,152 * 8/1995 Huang ..... 200/345

FOREIGN PATENT DOCUMENTS 34 37 875 5/1985 (DE) .
0 654 727 5/1995 (EP) .

* cited by examiner

*Primary Examiner*—John S. Hilten
*Assistant Examiner*—Leslie J. Grohusky
(74) *Attorney, Agent, or Firm*—Westman, Champlin & Kelly, P.A.

(57) ABSTRACT

An ergonomic keyboard includes a top case having a plurality of key planes that are non-parallel with one another. A plurality of keyswitch bases are positioned within respective ones of the plurality of key planes and are formed with the top case as a single, continuous piece of material.

18 Claims, 11 Drawing Sheets

KEYBOARD HAVING INTEGRALLY MOLDED KEYSWITCH BASE

BACKGROUND OF THE INVENTION

The present invention relates to computer interface devices. In particular, the present invention relates to a keyswitch base for computer keyswitches.

Keyswitches are used in a variety of computer interface devices, such as keyboards, gaming devices, stand alone switches and mouse switches. For example, a typical keyboard includes a top case, a bottom case, and one or more keyswitch bases which are mounted within the top case. Each keyswitch base includes an array of one or more square or round silos for supporting an array of one or more corresponding keyswitch plungers. An array of sensors are mounted to the back of the keyswitch base such that actuation of a keyswitch plunger changes the state of a corresponding sensor. This change in state is detected by the system to which the keyboard is connected. Several types of technologies have been used for sensing actuation of a keyswitch plunger, such as direct electrical contact, capacitive, electromagnetic and optical technologies.

Keyboards have traditionally had a flat design in which all keyswitches lie in the same key plane. Manufacturers are now beginning to offer ergonomic keyboards having multiple sets of angled key planes. For example, the Microsoft NATURAL KEYBOARD® input device has a top case which defines three sets of key planes that are not parallel to one another. Three keyswitch bases are molded as separate plastic parts and then installed in the corresponding key planes of the top case.

With traditional silo designs, the direction of pull between the two halves of the injection molding tool must be aligned with the direction of keyswitch operation (i.e., normal to the keyswitch base). Since each keyswitch base lies in a different and non-parallel key plane, separate injection molding tools, separate assembly steps and separate alignment steps are required for each keyswitch base. The inventors of the present application have found that with traditional silo designs, the only way to integrate the keyswitch bases and the top case together as one plastic piece would be to add moving mechanisms such as slides and lifters to the injection molding tool. However, adding slides and lifters has the disadvantage of increasing tool complexity, tool fabrication costs, maintenance costs, cycle times and part costs. These add to the product cost of goods sold ("COGS") through increased inventory and assembly times.

SUMMARY OF THE INVENTION

One aspect of the present invention relates to an ergonomic keyboard which includes a top case having a plurality of key planes that are non-parallel with one another. A plurality of keyswitch bases are positioned within respective ones of the plurality of key planes and are formed with the top case as a single, continuous piece of material.

Another aspect of the present invention relates to a keyswitch base for supporting a keyswitch plunger. The keyswitch base includes a frame having an aperture. A silo extends upward from the frame for receiving the keyswitch plunger. The silo has a non-closed side wall structure which partially surrounds the aperture.

Another aspect of the present invention relates to a keyboard having a top case, a keyswitch base, a keyswitch plunger, a keyswitch sensor and a bottom case. The top case includes a key plane and an aperture. The keyswitch base is positioned within the key plane and is formed with the top case as a single, continuous piece of material. The keyswitch base includes a silo having a non-closed side wall structure which partially surrounds the aperture. The keyswitch plunger includes a stem which is slidably mounted to the silo. The keyswitch sensor is mounted to the keyswitch base under the silo. The bottom case is mounted to the top case and encloses the keyswitch sensor between the bottom case and the top case.

Yet another aspect of the present invention relates to an ergonomic keyboard which includes a top case having a plurality of key planes that are non-parallel with one another. The keyboard further includes a structure for slidably supporting a plurality of keyswitch plungers within the plurality of key planes and being formed within the top case as a single, continuous piece of material.

Yet another aspect of the present invention relates to a method of fabricating a top case of a keyboard. The method includes molding the top case between first and second mold pieces in a single molding step, and forming a plurality of keyswitch bases within the top case in a plurality of non-parallel key planes during the single molding step. At least one silo is formed within each keyswitch base during the single molding step.

DETAILED DESCRIPTION OF ILLUSTRATIVE EMBODIMENTS

The present invention is directed to a keyswitch base which can be fabricated integrally within a top case of an input device in multiple, non-parallel key planes.

Figure 1:
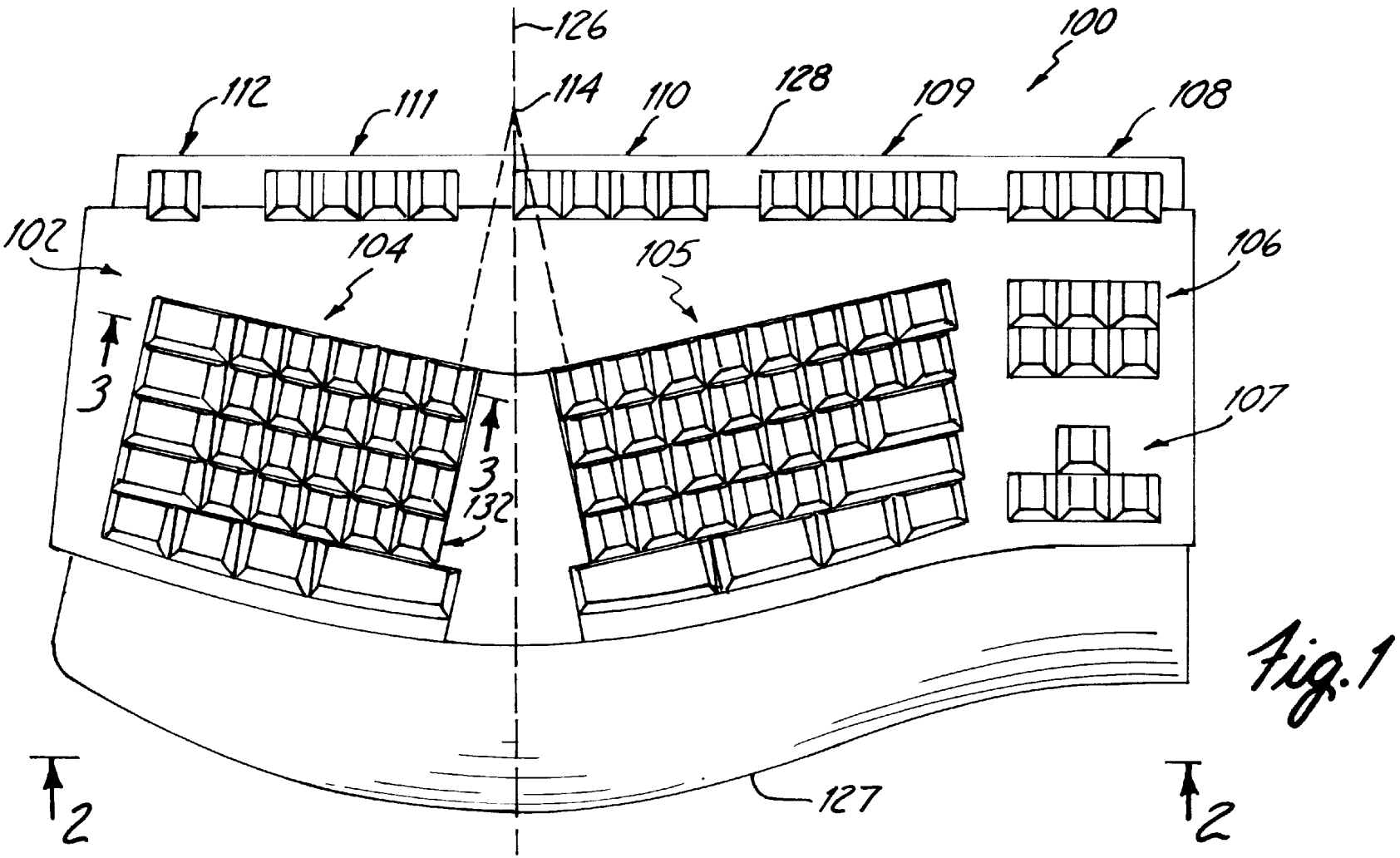
FIG. 1 is a top plan view of an ergonomic keyboard which can be used in the system shown in FIG. 1.
Figure 2:
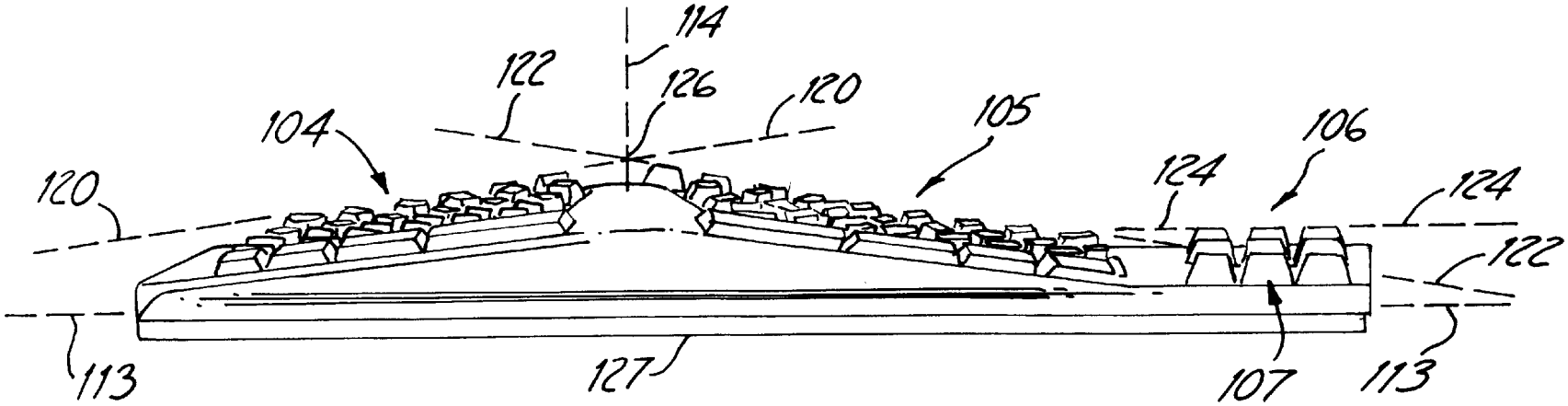
FIG. 2 is a front elevation view of the keyboard shown in FIG. 2, as viewed along lines 2—2 of FIG. 1.

FIG. 1 is a top plan view of an ergonomic keyboard 100 which includes an integral keyswitch base according to one embodiment of the present invention. FIG. 2 is a front elevation view of keyboard 100 as viewed along lines 2—2 of FIG. 1. Although FIGS. 1 and 2 show a keyboard for a desktop computer, the keyswitch base of the present invention can also be used in other input devices such as a portable or notebook computer keyboard, a gaming device, a stand-alone switch, a stand-alone switch array, a mouse switch and the like.

Keyboard 100 includes top case 102 and key banks 104–112. Each key bank has one or more rows of keyswitches. The rows of keyswitches in banks 104 and 105 are rotated with respect to one another along a horizontal reference plane 113 (shown in FIG. 2), about a vertical axis of rotation 114. The rows or keyswitches in bank 104 are not parallel to the rows of keyswitches in bank 105. Also, the rows of keyswitches in banks 104 and 105 are not parallel to the rows of keyswitches in banks 106–112.

Looking at FIG. 2, top case 102 has a plurality of key planes 120, 122 and 124. Key banks 104, 111 and 112 lie in key plane 120. Key banks 105, 109 and 110 lie in key plane 122. Key banks 106, 107 and 108 lie in key plane 124. Key planes 120, 122 and 124 are not parallel with one another. Key planes 120 and 122 are rotated with respect to one another about a horizontal axis of rotation 126 (shown in FIG. 1), which extends generally from front keyboard edge 127 to back keyboard edge 128. Also, key planes 120, 122 and 124 angle downward from back keyboard edge 128 toward front keyboard edge 127.

The key or keys in each key bank can reside in individual planar keyswitch bases as shown in FIGS. 1–2 or can reside in curved recesses, curved protrusions or other shaped bases in alternative embodiments. For example, the keyboard can have keys arranged around a cylindrical shape or in curved semi-spherical recesses. The term "key plane" used in the specification and the claims refers to a tangential plane of the keyswitch base at each key, within any of these geometries.

Figure 3:
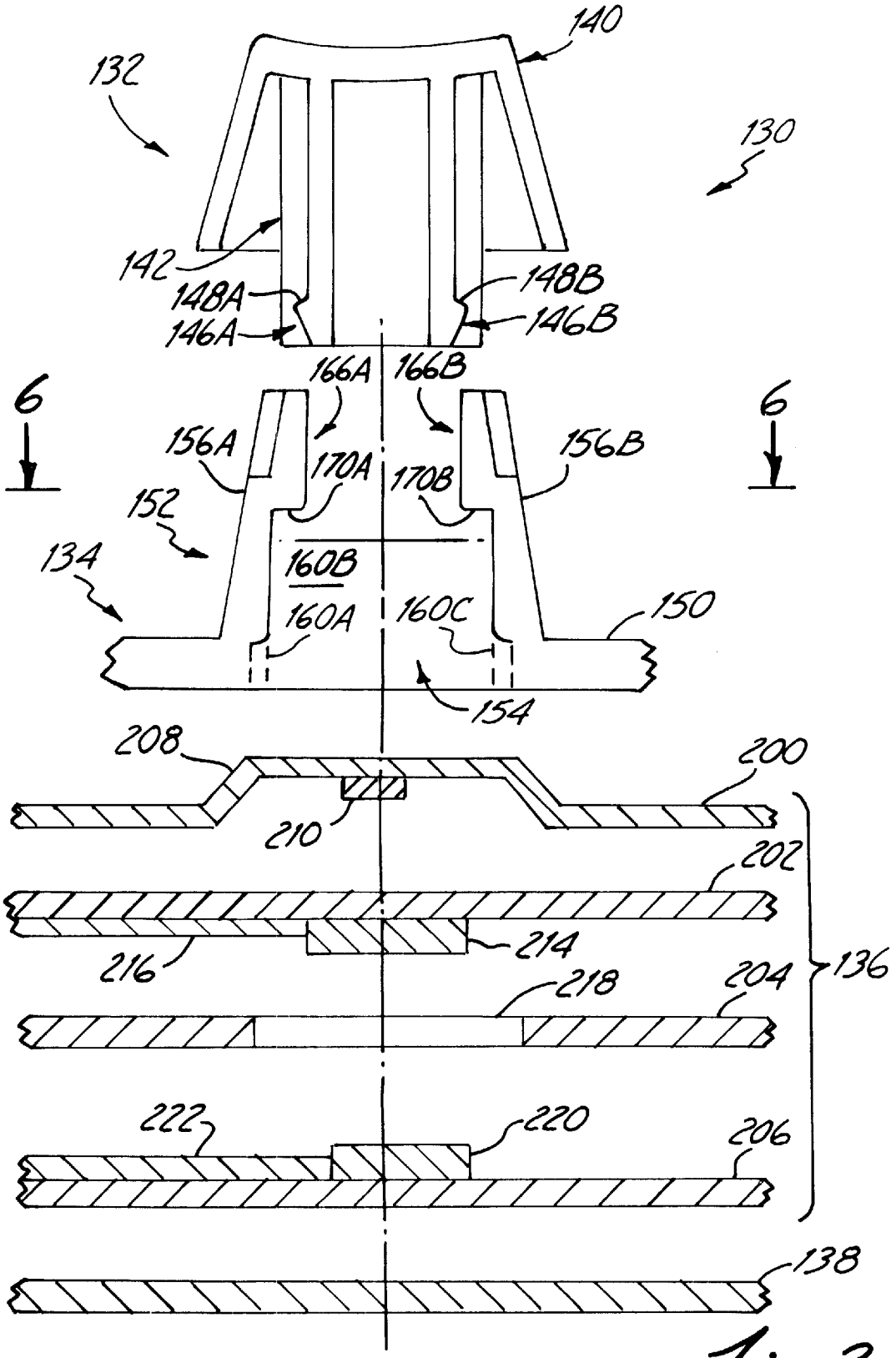
FIG. 3 is an exploded view of an individual keyswitch in the keyboard shown in FIGS. 1 and 2, as viewed in cross-section along lines 3—3 of FIG. 1.

FIG. 3 is an exploded view of an individual keyswitch 130 in bank 104 as viewed in cross-section along lines 3—3 of FIG. 2. Keyswitch 130 includes keyswitch plunger 132, keyswitch base 134, keyswitch sensor 136 and backing plate 138. Keyswitch plunger 132 includes key cap 140 and stem 142 which extends downward from key cap 140 toward keyswitch base 134. Stem 142 includes a pair of outwardly facing, opposing snaps 146A and 146B. Snaps 146A and 146B have locking surfaces 148A and 148B, respectively, which face upward toward key cap 140.

Keyswitch base 134 includes a frame 150, formed by top case 102 (shown in FIG. 1), and a raised silo 152. Frame 150 has an aperture 154 for each keyswitch 130. Silo 152 has a non-closed side wall structure which is formed by blades 156A and 156B. Blades 156A and 156B partially surround aperture 154. Blades 156A and 156B are symmetrical with and oppose one another across aperture 154. In one embodiment, aperture 154 is substantially rectangular. However, other aperture shapes can also be used, such as circular, oval or irregular shapes. Frame 150 has edges 160A–160D (160D not shown) which border aperture 154. Blades 156A and 156B extend upward from frame 150 along edges 160A and 160C, respectively. Silo 152 is free of material along edges 160B and 160D.

Blades 156A and 156B include inside surfaces which face aperture 154 and outside surfaces which face away from aperture 154. Blade protrusions 166A and 166B extend from the inside surfaces into aperture 154. Blade protrusions 166A and 166B have lower, latch receiving surfaces 170A and 170B which face frame 150.

Silo 152 receives stem 142 through aperture 154. During installation, stem 142 is inserted into aperture 154 while snaps 146A and 146B are deflected toward one another until locking surfaces 148A and 148B engage the corresponding latch receiving surfaces 170A and 170B. Surfaces 170A and 170B retain stem 142 within silo 152 while allowing keyswitch plunger 132 to be actuated upward and downward within the cavity.

Keyswitch sensor 136 includes a plurality of layers 200, 202, 204 and 206 which are mounted to backing plate 138 and then aligned with keyswitch base 134. The dimensions of layers 200, 202, 204 and 206 are exaggerated in FIG. 3 for clarity. Layer 200 includes one or more rubber domes 208 which can be formed individually or together in a common sheet. Each dome 208 is aligned with a corresponding one of the apertures 154 on frame 150 such that the lower surface of stem 142 contacts the upper surface of the dome when the stem is installed in silo 152. Each dome 208 can be formed of rubber or any other flexible, resilient material. The lower surface of dome 208 includes a contact 210 which engages the upper surface of layer 202 when dome 208 is depressed by keyswitch plunger 132. Dome 208 is molded in a form that will collapse when keyswitch plunger 132 is depressed and will provide the user with a tactile snap upon collapse.

Layer 202 includes a substrate formed of a flexible dielectric material, such as mylar, which supports a conductive pad 214 on its lower surface. Other resilient dielectric materials can also be used. Conductive pad 214 is electrically coupled to a conductive trace 216. Layer 202 deflects downward when contact 210 is forced against the upper surface of layer 202. In one embodiment, substrate 202 is about 0.003 inches thick.

Layer 204 includes a substrate formed of a thin layer of dielectric material, such as mylar, having an aperture 218 which is concentrically aligned with conductive pad 214. Layer 206 includes a substrate formed of a flexible dielectric material, such as mylar, which supports a conductive pad 220 on its upper surface. Conductive pad 214 is electrically coupled to a conductive trace 222 and opposes conductive pad 214 across aperture 218.

When plunger 132 is depressed, the lower surface of stem 142 collapses dome 208 causing contact 210 to deflect substrate 202. Deflection of substrate 202 causes conductive pad 214 to contact conductive pad 220 through aperture 218, thereby closing an electrical current path between conductive traces 216 and 222. Sensor circuitry (not shown) associated with keyboard 100 senses the closed current path and provides an electrical signal to a hardware or software driver for the keyboard.

Keyswitch sensor 136 shown in FIG. 3 is merely one example of a type of sensor which can be used to detect depression of one or more of the keyswitches. Other types of sensors can also be used, such as other direct contact sensors, capacitive sensors, electromagnetic sensors and optical sensors.

Figure 4:
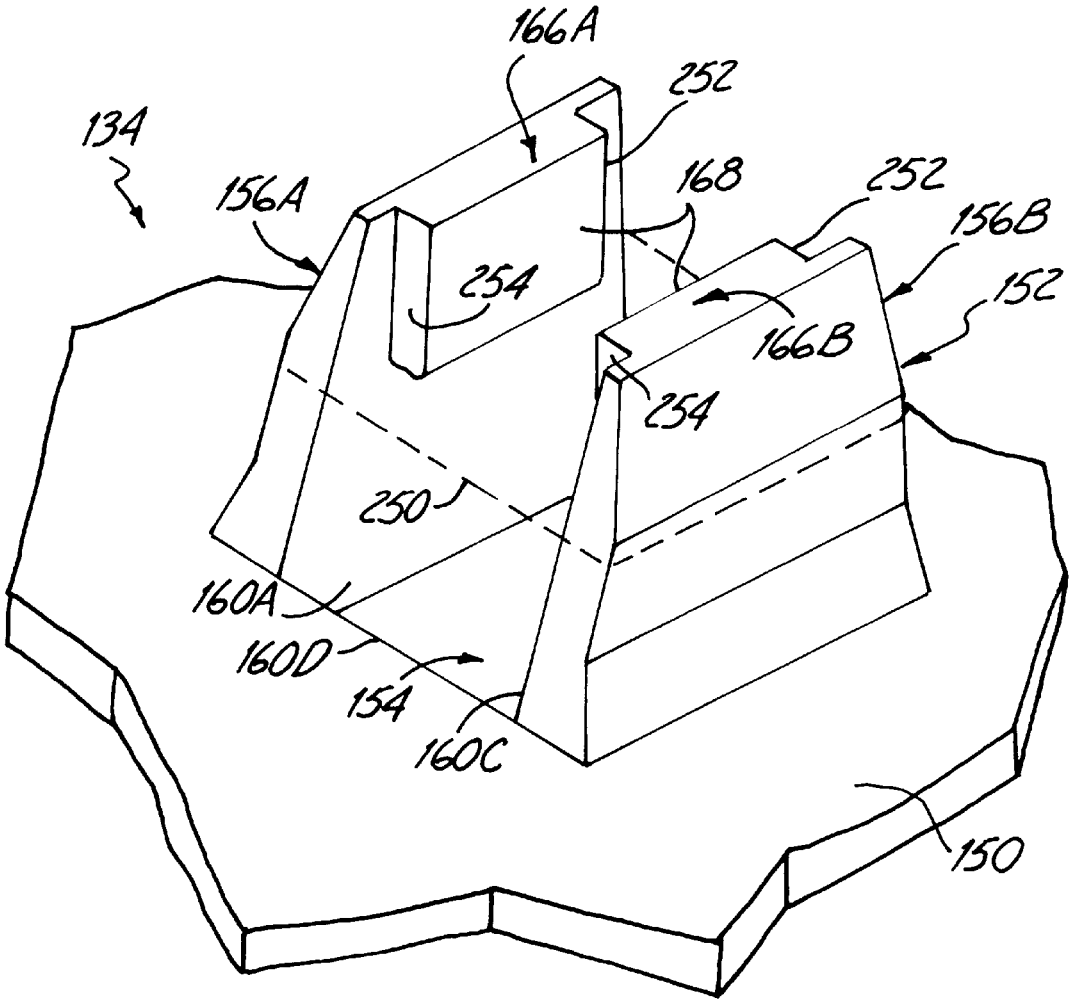
FIG. 4 is a perspective view of keyswitch base used in the keyboard according to one embodiment of the present invention.

FIG. 4 is a perspective view of keyswitch base 134 showing silo 152 in greater detail according to one embodiment of the present invention. As seen in FIG. 4, silo 152 has a side wall structure formed by opposing blades 156A and 156B. Blades 156A and 156B are parallel to one another and oppose another across aperture 154. Blade 156A extends upward from edge 160A, and blade 156B extends upward from edge 160C (shown in FIG. 3). In the embodiment shown in FIG. 4, the side wall structure is free of material along edges 160B (shown in FIG. 3) and 160D. Therefore, the side wall structure formed by opposing blades 154A and 154B has a non-closed perimeter shown by dashed line 250. Perimeter 250 is open along opposing edges 160B and 160D of aperture 154. In an alternative embodiment, a further blade (not shown) extends upward from edge 160B (shown in FIG. 3) which closes the side wall structure between the far ends of blades 156A and 156B in FIG. 4. The side wall structure of silo 152 would still remain open along edge 160D for removing a molding tool as described in more detail below. The side wall structure may further include a short, partial wall along edge 160D to aid in spill resistance. Other variations are also possible.

Blade protrusions 166A and 166B have opposing bearing surfaces 168, which face aperture 154 and lie in planes that are perpendicular to a plane defined by keyswitch frame 150. In addition, bearing surfaces 252 and 254 are formed along the sides of blade protrusions 166A and 166B. Bearing surfaces 254 face aperture edge 160D and are generally perpendicular to bearing surfaces 168 and the plane defined by keyswitch frame 150. Bearing surfaces 252 face a direction opposite to bearing surfaces 254, toward aperture edge 160B (shown in FIG. 3) and are generally perpendicular to bearing surfaces 168 and the plane defined by keyswitch frame 150. In the embodiment shown in FIG. 4, bearing surfaces 252 and 254 are planar. However, bearing surfaces 252 and 254 can have a variety of curved or multi-surfaced shapes. Bearing surfaces 168, 252 and 254 form guides for slidably receiving stem 142 of keyswitch plunger 132 (shown in FIG. 3).

Figure 5:
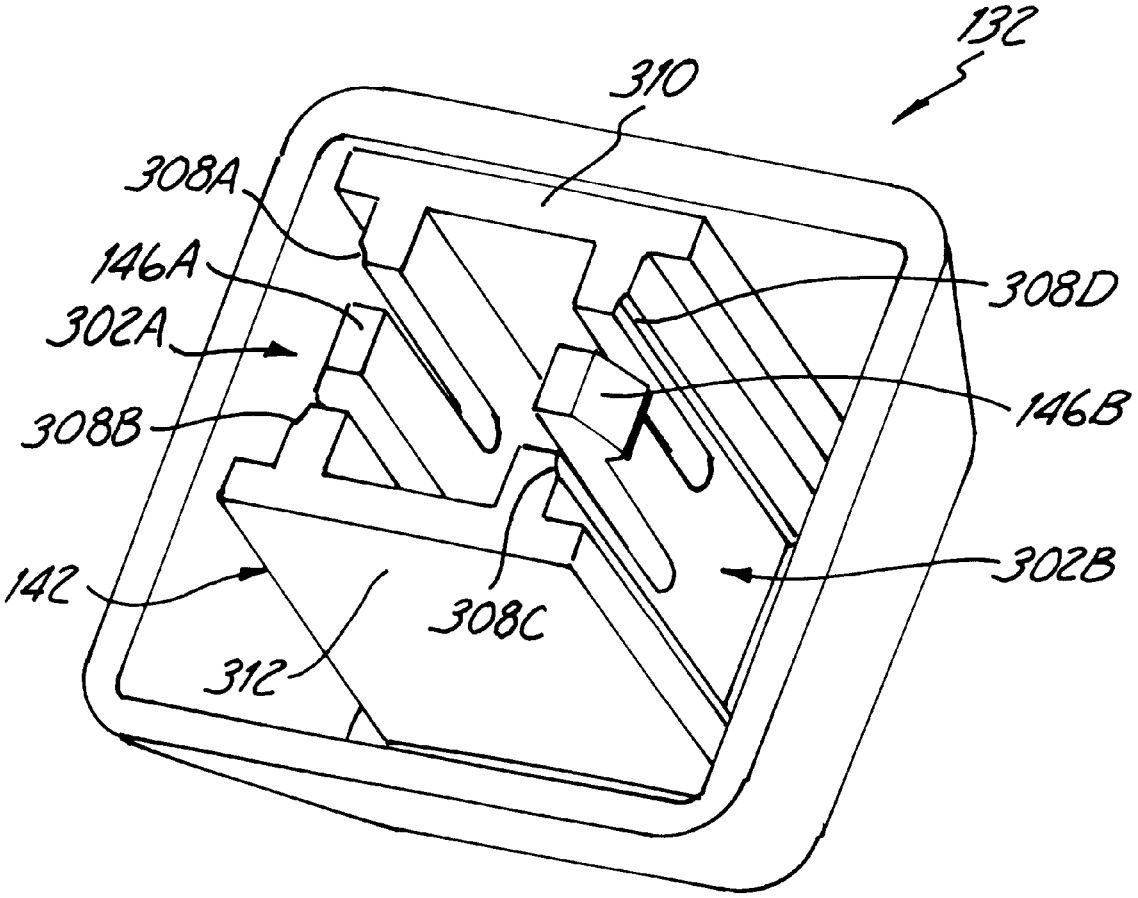
FIG. 5 is a perspective view of a keyswitch plunger used in the keyboard, according to one embodiment of the present invention.

FIG. 5 is a perspective view of keyswitch plunger 132 as viewed from stem 142. Stem 142 has a generally hollow rectangular shape and includes snaps 146A and 146B and a pair of guide paths 302A and 302B. Guide paths 302A and 302B receive blade protrusions 166A and 166B, respectively, of silo 152 (shown in FIG. 4). Guide path 302A has bearing surfaces for engaging bearing surfaces 168, 252 and 254 of blade protrusion 166A. Similarly, guide path 302B has bearing surfaces for engaging bearing surfaces 168, 252 and 254 of blade protrusion 166B. In FIG. 5, the bearing surfaces formed by guide paths 302A and 302B are generally planar. In an alternative embodiment, these bearing surfaces are rounded to provide a linear bearing as opposed to a planar bearing.

Stem 142 further includes a pair of longitudinal cutouts along snaps 146A and 146B which allow snaps 146A and 146B to be deflected when inserted within silo 152. Stem 142 has a solid side walls 310 and 312 for providing structural integrity for plunger 132 and increasing stability of the plunger during actuation. However, side walls 310 and 312 can be open or otherwise free or partially free of material in alternative embodiments.

In FIG. 5, stem 142 has a substantially rectangular shape. Stem 142 can have a variety of alternative shapes, such as circular or oval as long as stem 142 has bearing surfaces which mate with or otherwise engage the corresponding bearing surfaces on silo 152 (shown in FIG. 4).

Figure 6:
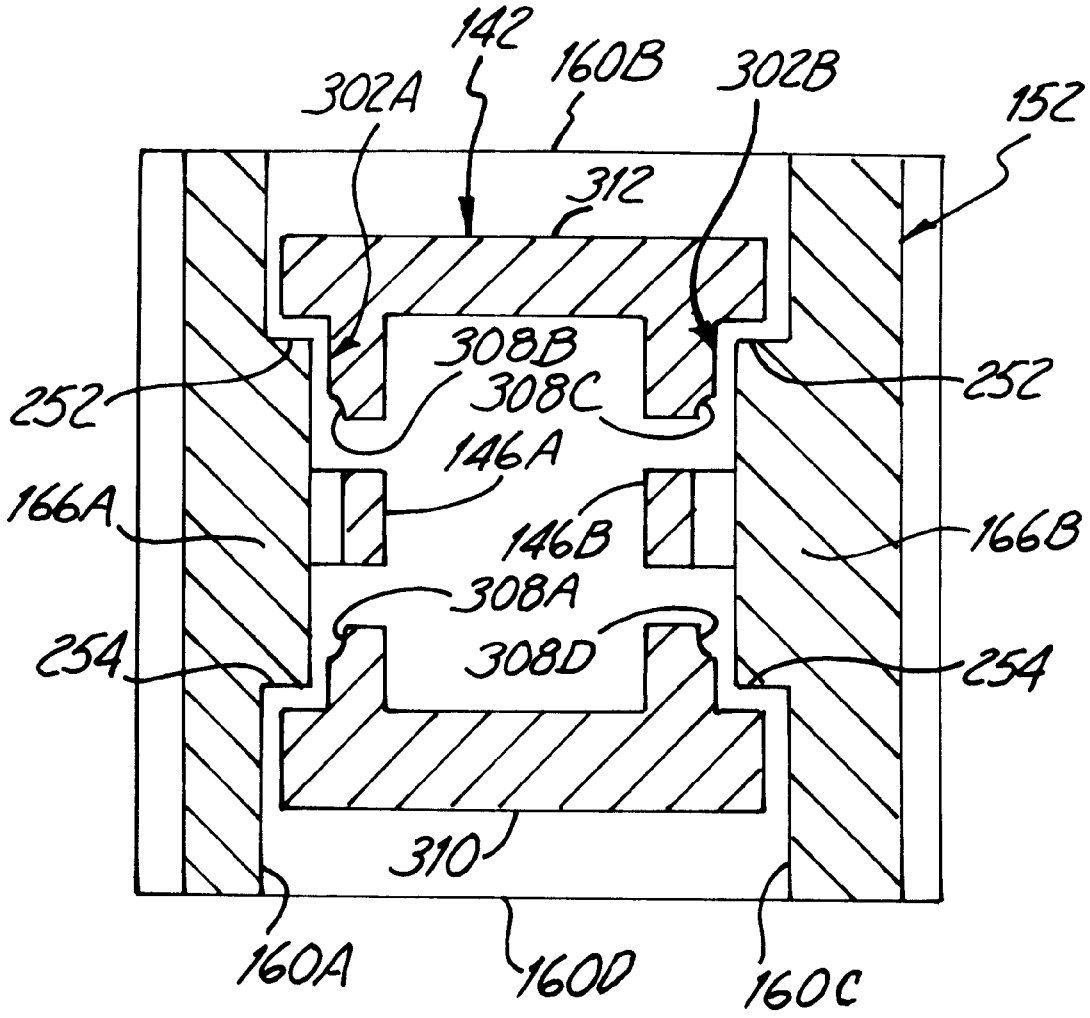
FIG. 6 is a cross-sectional view of the keyswitch plunger installed within a silo of the keyswitch base, as viewed from lines 6—6 of FIG. 3.

FIG. 6 is a cross-sectional view of stem 142 positioned within silo 152 as viewed from lines 6—6 of FIG. 3. The bearing surfaces in guide paths 302A and 302B are raised with respect to the remaining material of stem 142 by offsets 308A–308D. This allows the lateral clearances between guide paths 302A and 302B and the respective bearing surfaces on blade protrusions 166A and 166B to be adjusted by varying the height of the offsets. The clearances can be adjusted to achieve a desired friction and stability between stem 142 and silo 152.

An advantage of keyswitch base 134 is that it allows the keyswitches to be highly scalable. The size of each keyswitch can be scaled by varying the length, width and thickness blade protrusions 166A and 166B along with corresponding variations in the dimensions of stem 142. Also, the stroke height of keyswitch plunger 132 can be varied by varying the height of blades 156A and 156B. For example, the stroke height can be reduced to achieve a very low profile switch for portable PCs and notebook computers, for example, as compared to desktop computers. However, for any given keyswitch size, the width of blade protrusions 166A and 166B, as measured between bearing surfaces 252 and 254 can be maximized, if desired, to provide as much stability as possible for keyswitch plunger 132.

As mentioned above, silo 152 has a non-closed side wall structure. Since the side wall structure remains open along aperture edges 160B and 160D, a plurality of silos 152 can be molded within top case 102 (shown in FIGS. 2 and 3) as a single, continuous piece of material and in multiple, non-parallel key planes.

Figure 7:
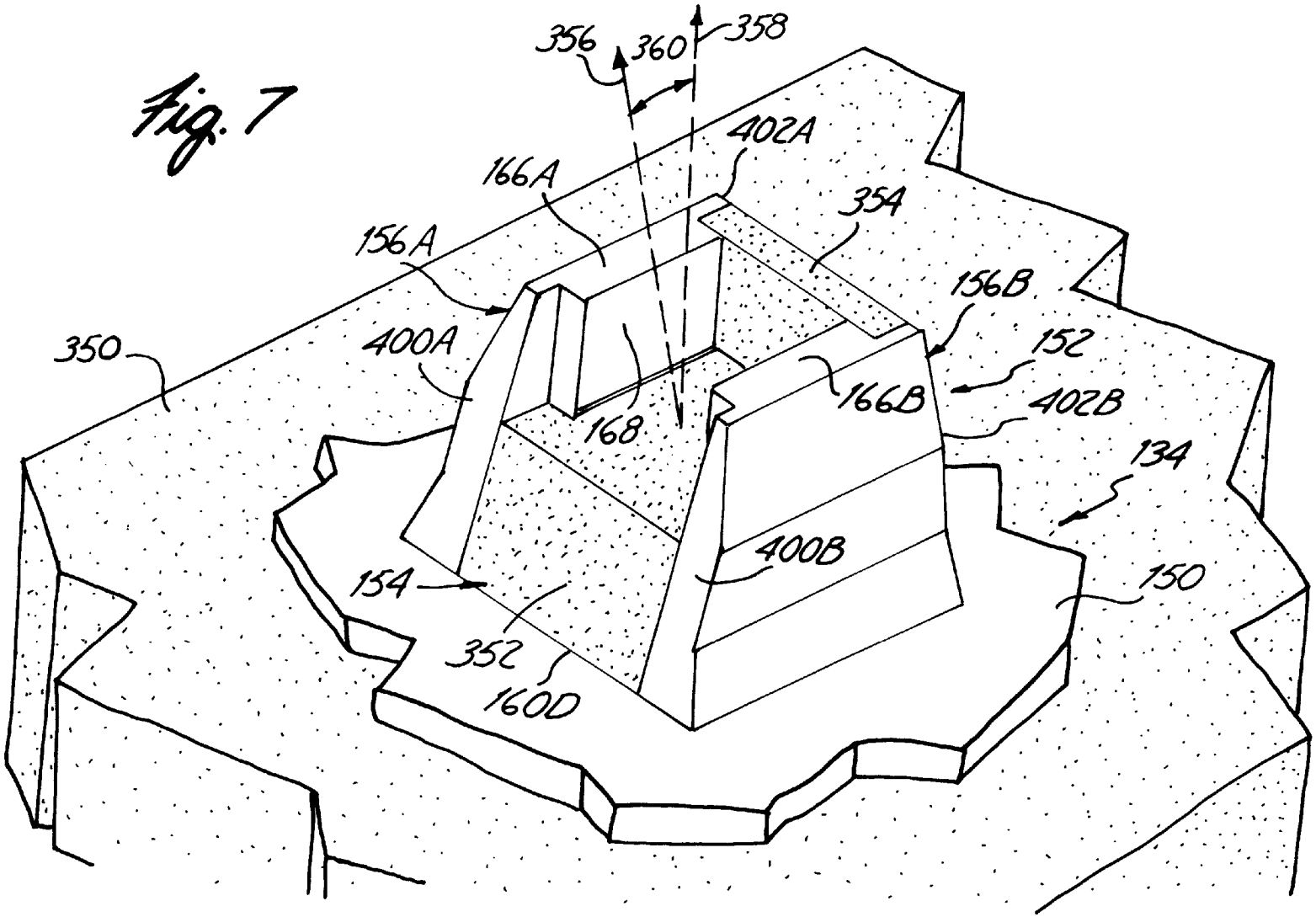
FIG. 7 is a perspective view of the keyswitch base positioned on a bottom half of a molding tool.

FIG. 7 is a perspective view of keyswitch base 134 on a bottom half 350 of a molding tool. Bottom half 350 comes up from the bottom of keyswitch base 134 through aperture 154. A first section 352 of mold half 350 terminates at the lower surface of blade protrusions 166A and 166B. A second section 354 of mold half 250 extends to the top of blades 156A and 156B, along the far side of blade protrusions 166A and 166B. The top half of the molding tool (not shown) comes down over the top of keyswitch base 134, along pull direction 356. Due to the multiple key planes in keyboard 100, pull direction 356 may be at an angle 360 with respect to a direction 358 of keyswitch operation, depending upon the location of the particular keyswitch in the keyboard.

Although pull direction 356 is not perpendicular to each of the keyswitch bases 134, the top half of the molding tool does not become locked within the molded material since the side wall structure of silo 152 is open along aperture edge 160D. After molding, the top half of the molding tool can simply be lifted from the bottom half 350 without the use of additional slides or lifters. This significantly reduces the complexity and resulting cost of the molding tool.

Blade 156A has lateral side surfaces 400A and 402A (shown in FIG. 7). Similarly, blade 156B has lateral side surfaces 400B and 402B. Side surfaces 400A and 400B are co-planar with one another and may extend upward at a non-perpendicular angle, for example, from keyswitch frame 150. Side surfaces 402A and 402B are co-planar with one another and may extend upward at a non-perpendicular angle, for example, from keyswitch frame 150. The particular angles can be adjusted as desired and are functions of the angle 360 between the pull direction 356 and the direction of keyswitch operation 358, the height of blades 166A and 166B and various other tooling factors.

Figure 8:
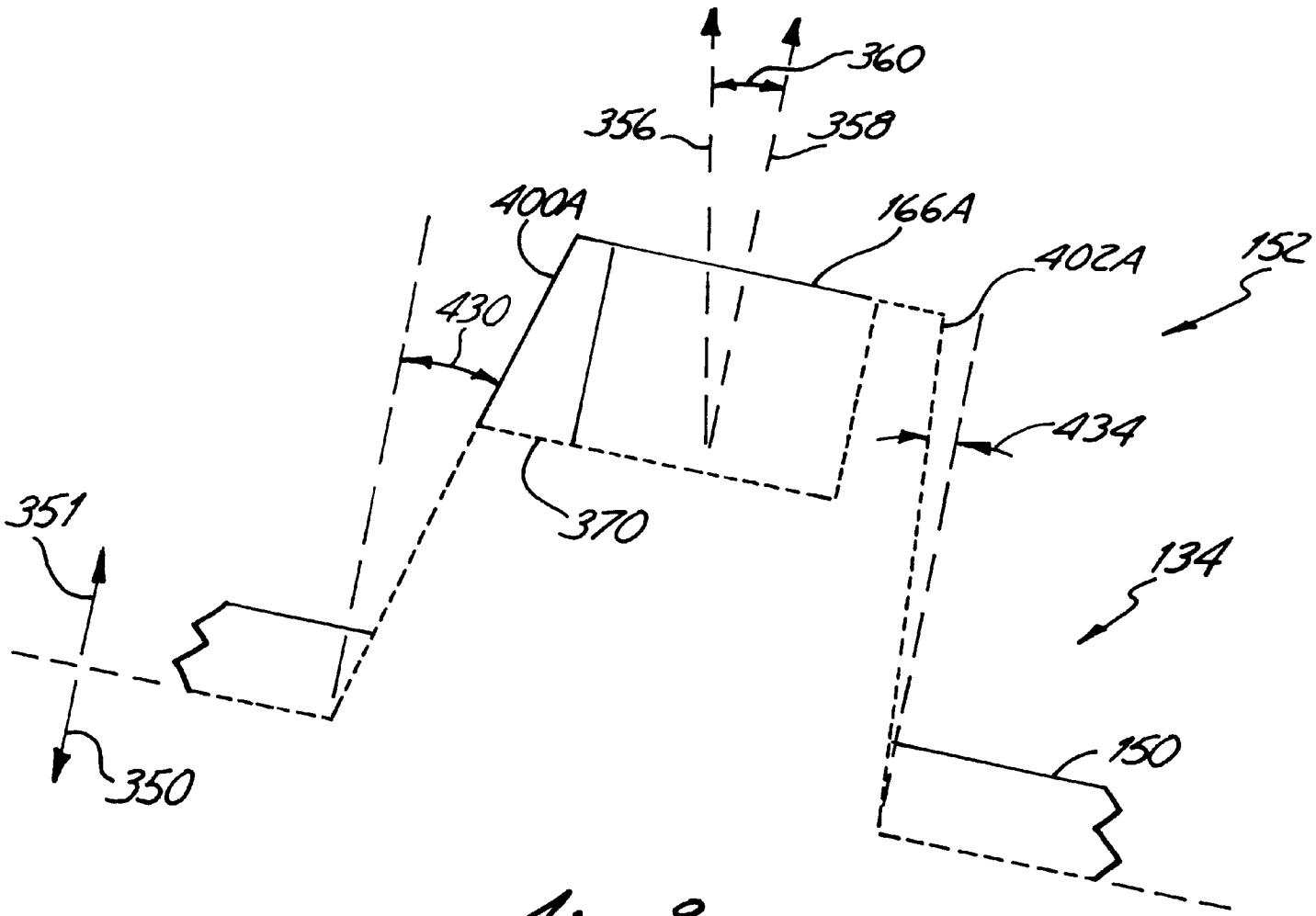
FIG. 8 is a cross-sectional view of the keyswitch base showing a parting line of the molding tool in greater detail.

FIG. 8 is a cross-sectional view of keyswitch base 134 showing a parting line 370 between the top and bottom halves of the molding tool. Bottom half 350 is below parting line 370, and top half 351 is above parting line 370. In one embodiment, the molding tool has two parting lines. As the first parting line opens, after molding, a core pin (not shown) is pulled from silo 152. Subsequently, the second parting line opens, such as parting line 370, and the part is ejected from the molding tool. Numerous other tooling arrangements are also possible. FIG. 8 also shows the angle 430 at which side walls 400A and 402A extend upward from keyswitch frame 150 and the angle 434 at which side walls 402A and 402B extend upward from keyswitch frame 150. Angle 430 is selected to allow silo 152 to fit within key cap 140(shown in FIG. 3) and varies with the shape of the key cap. The shape of key cap 140 can vary from keyboard to keyboard. Angle 434 provides draft which allows the top and bottom halves 351 and 350 of the molding tool to part after molding. In one embodiment, angle 434 is at least one degree. A small angle maximizes the material in blades 166A and 166B while providing clearance between walls 402A and 402B and the top half of the molding tool 351 when the top half is separated from the bottom half 350 in pull direction 356.

Figure 9:
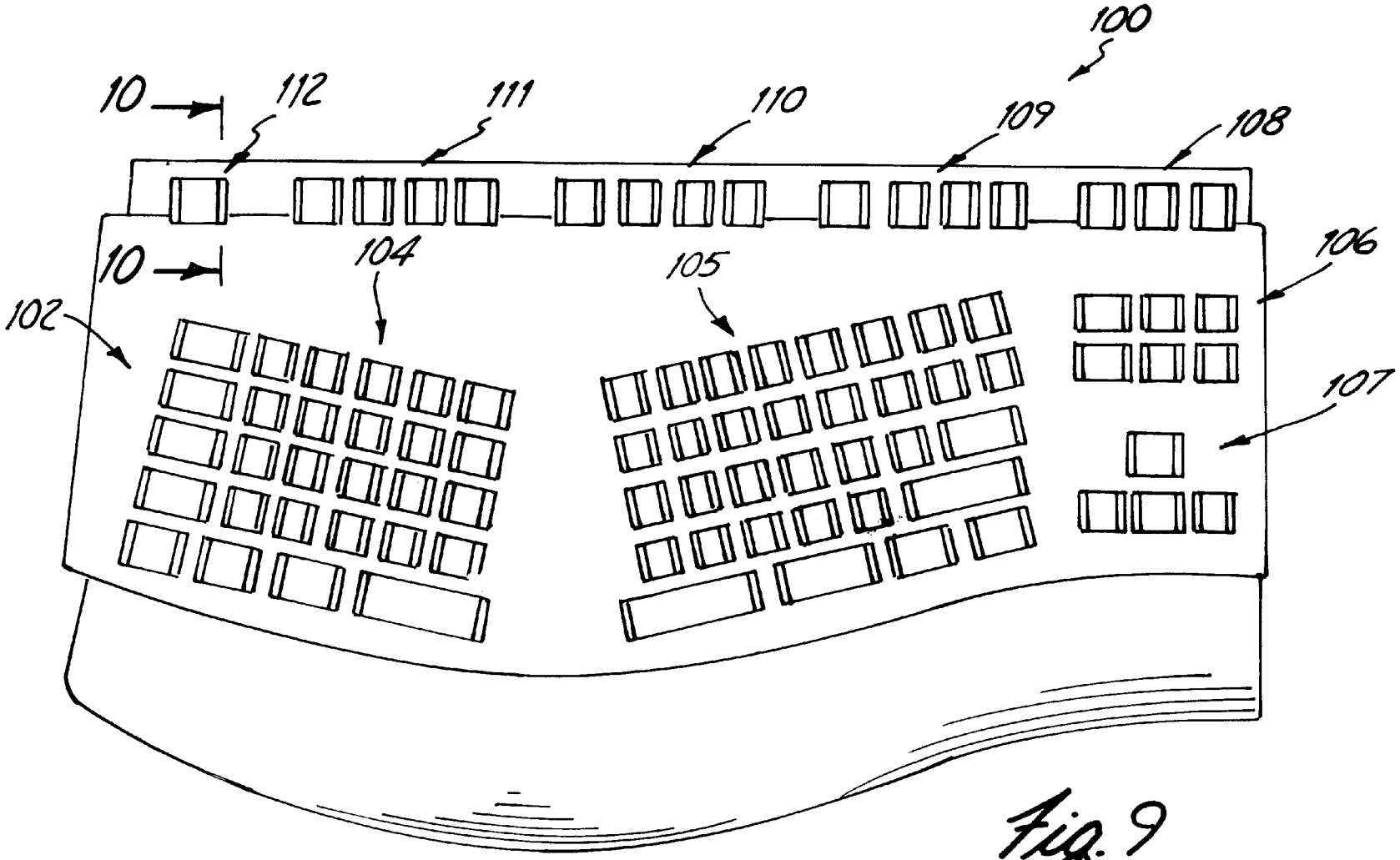
FIG. 9 is a top plan view of the keyboard with the keyswitch plungers of each of the keyswitches removed.

FIG. 9 is a top plan view of keyboard top case 102 with keyswitch plungers 132 of each of the keyswitches removed. Each of the key banks 104–112 has a keyswitch base with a matrix of one or more silos 152, which are molded with top case 102 as a single, continuous piece of material. As described with reference to FIGS. 2 and 3, key banks 104–112 lie in multiple key planes which are non-parallel with one another. Providing silos 152 with non-closed side wall structures allows the molding tool to have varying pull angles in the various key planes defined by top case 102. As such, top case 102 and all of the keyswitch bases can be molded together in a single molding operation. This significantly reduces the number of molding tools and assembly steps required to manufacture keyboard 100. This also significantly reduces the manufacturing time for each keyboard and thus the cost of goods sold.

Figure 10:
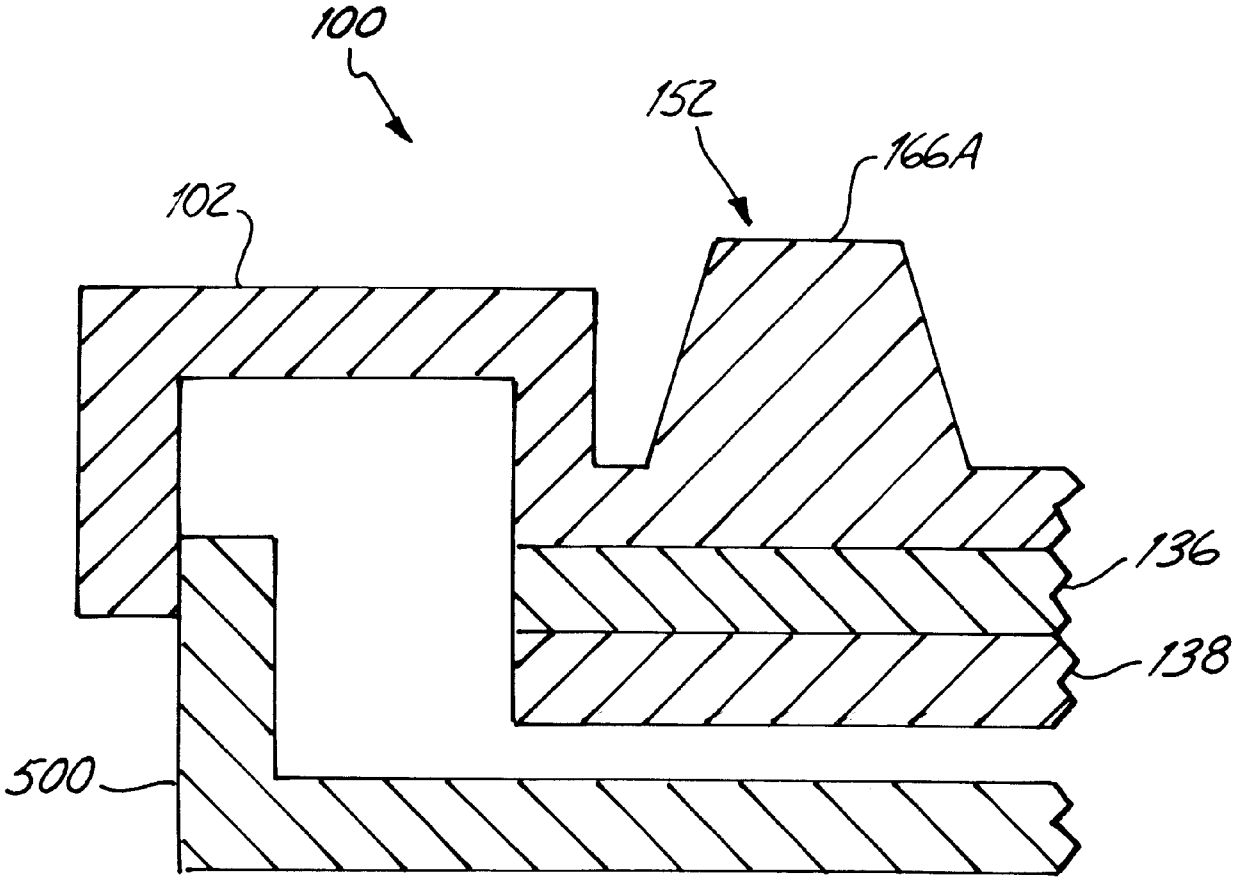
FIG. 10 is a sectional view of the keyboard taken along lines 10—10 of FIG. 9.

FIG. 10 is a sectional view of keyboard 100 taken along lines 10—10 of FIG. 9. Keyboard 100 includes top case 102 with integrated silo 152, bottom case 500, sensor layer 136 and backing plate 138. Once top case 102 and bottom case 500 are molded, sensor layer 136 and backing plate 138 are assembled onto top case 102. Top case 102 is then installed on top of bottom plate 500 and secured in a well-known manner with screws or permanent snaps, for example.

Figure 11:
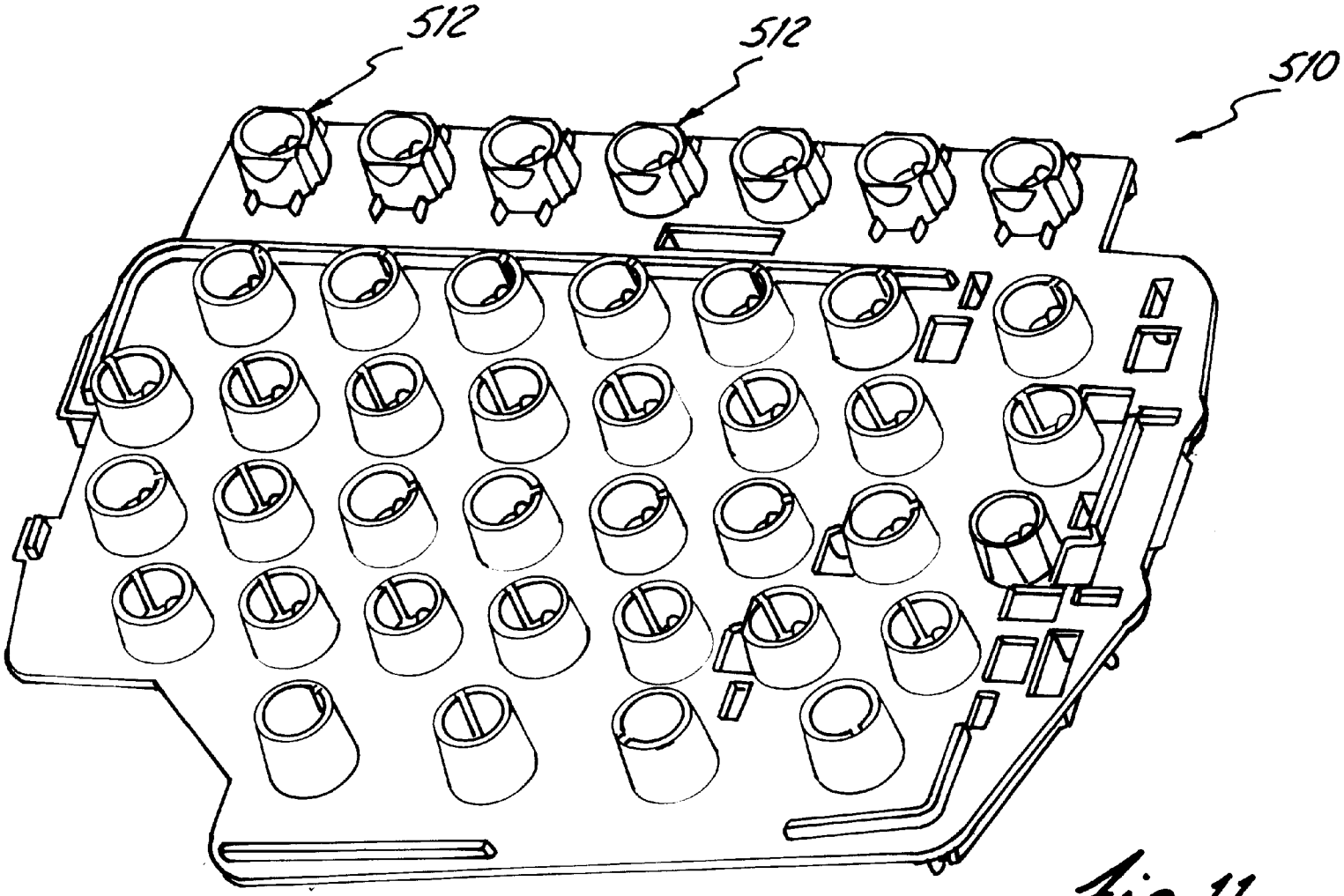
Fig. 11 (PRIOR ART)
FIG. 11 is a perspective view of a keyswitch base of the prior art.

FIG. 11 is a perspective view of a keyswitch base 510, which includes a plurality of round, closed silos 512 according to the prior art. With a closed side wall structure, the pull direction for the molding tool is aligned with the direction of keyswitch operation, normal to the keyswitch base. This allows the top and bottom halves of the molding tool to separate after molding. However, this also makes it difficult to integrate the keyswitch base with the top case of an ergonomic keyboard having multiple, non-parallel key planes without the addition of moving mechanisms such as slides and lifters to the injection molding tool. Adding slides and lifters has the disadvantage of increasing tool complexity, tool fabrication costs, maintenance costs, cycle times and part costs. These add to the product cost of goods sold through increased inventory and assembly times.

Although the present invention has been described with reference to particular embodiments, workers skilled in the art will recognize that changes may be made in form and detail without departing from the spirit and scope of the invention.

What is claimed is:

1. A keyswitch base for supporting a keyswitch plunger, the keyswitch base comprising:

a frame having an aperture; and a silo extending upward from the frame for receiving the keyswitch plunger and comprising a non-closed side wall structure which partially surrounds the aperture, wherein the frame and the silo are formed as a single continuous piece of material.

2. The keyswitch base of claim 1 wherein the side wall structure comprises:

first and second blades which oppose one another across the aperture.

3. The keyswitch base of claim 2 wherein the first and second blades are parallel and symmetrical to one another.

4. The keyswitch base of claim 2 wherein the first and second blades each have first and second side surfaces and wherein the side wall structure of the silo is free of material between the first side surfaces of the first and second blades and is free of material between the second side surfaces of the first and second blades.

5. The keyswitch base of claim 2 wherein:

the first and second blades each have first and second side surfaces;

the first side surfaces of the first and second blades are coplanar with one another and extend upward from the frame at a first non-perpendicular angle from a plane defined by the frame; and the second side surfaces of the first and second blades are coplanar with one another and extend upward from the frame at a second non-perpendicular angle from a plane defined by the frame.

6. The keyswitch base of claim 2 wherein:

the aperture is substantially rectangular;

the frame has first, second, third and fourth edges which border the aperture;

the first and second blades extend upward from the first and third edges, respectively; and the side wall structure is free of material along the second and fourth edges.

7. The keyswitch base of claim 2 wherein each of the first and second blades comprises:

an inside surface which faces the aperture and an outside surface which faces away from the aperture; and a first plunger bearing surface formed on the inside surface, wherein the first plunger bearing surface is perpendicular to a plane defined by the frame.

8. The keyswitch base of claim 7 wherein each of the first and second blades further comprises:

a blade protrusion which extends into the aperture in a direction toward the other of the first and second blades, wherein the first plunger bearing surface is formed on the blade protrusion and wherein the blade protrusion comprises first and second side surfaces which are generally perpendicular to the first bearing surface and form second and third plunger bearing surfaces.

9. The keyswitch base of claim 2 wherein:

each of the first and second blades further comprises a plunger guide having a first bearing surface which faces the aperture, a second bearing surface which is generally perpendicular to the first bearing surface, and a third bearing surface which is generally perpendicular to the first bearing surface and faces a direction opposite than the second bearing surface faces.

10. The keyswitch base of claim 2 wherein the first and second blades each comprise:

an inside surface which faces the inside surface of the other of the first and second blades; and a latch receiving surface positioned along the inside surface and facing the frame.

11. A keyboard comprising:

a top case having a first key plane and an aperture;

a first keyswitch base which is positioned within the first key plane and is formed with the top case as a single, continuous piece of material, wherein the keyswitch base comprises a first silo having a non-closed side wall structure which at least partially surrounds the aperture;

a first keyswitch plunger having a first stem slidably mounted to the first silo; and a first keyswitch sensor mounted to the keyswitch base under the first silo.

12. The keyboard of claim 11 wherein the first key plane forms the only key plane in the top case.

13. The keyboard of claim 11 wherein:

the top case further comprises a second key plane;

the first and second key planes are non-parallel with one another; and the keyboard further comprises:

a second keyswitch base which is positioned within the second key plane and is formed with the first keyswitch base and the top case as the single, continuous piece of material, wherein the second keyswitch base comprises a second silo which has a non-closed side wall structure; and a second keyswitch plunger having a second stem slidably mounted to the second silo;

a second keyswitch sensor mounted to the second keyswitch base under the second silo; and a bottom case mounted to the top case and enclosing the first and second keyswitch sensors between the bottom case and the top case.

14. The keyboard of claim 13 wherein:

the top case further comprises a third key plane;

first, second and third key planes are non-parallel with one another;

the keyboard further comprises:

a third keyswitch base which is positioned within the third key plane and is formed with the first and second keyswitch bases and the top case as the single, continuous piece of material, wherein the third keyswitch base comprises a third silo which has a non-closed side wall structure;

a third keyswitch plunger having a third stem slidably mounted to the third silo; and a third keyswitch sensor mounted to the third keyswitch base under the third silo; and the bottom case encloses the first, second and third keyswitch sensors between the bottom case and the top case.

15. The keyboard of claim 11 wherein the side wall structure comprises first and second parallel blades which oppose one another across the aperture.

16. The keyboard of claim 15 wherein:

the first and second blades comprise first and second guides, respectively; and the stem mates with the first and second guides.

17. A keyboard comprising:

a top case having at least one key plane and an aperture; and a keyswitch base which is positioned within the key plane and is formed with the top case as a single, continuous piece of material, wherein the keyswitch base comprises a silo having a non-closed side wall structure which at least partially surrounds the aperture.

18. A keyswitch base for supporting a keyswitch plunger, the keyswitch base comprising:

a frame having an aperture with a closed perimeter; and a silo extending upward from the frame and comprising first and second blades which oppose one another across the aperture along opposing portions of the perimeter for receiving the keyswitch plunger and forming a non-closed side wall structure which partially surrounds the aperture, wherein the side wall structure is free of material along the perimeter between the first and second blades.

* * * * *

UNITED STATES PATENT AND TRADEMARK OFFICE

CERTIFICATE OF CORRECTION

PATENT NO. : 6,224,279 B1
DATED : May 1, 2001
INVENTOR(S) : Kennard E. Nielsen et al.

It is certified that error appears in the above-identified patent and that said Letters Patent is hereby corrected as shown below:

Column 3,
Line 10, after "rows", delete "or" and insert -- of --.

Column 4,
Line 59, after "oppose", insert -- one --.

Column 5,
Line 67, after "thickness", insert -- of --.

Column 6,
Line 22, after "half", delete "250" and insert -- 350 --.

Signed and Sealed this

Eighteenth Day of December, 2001

*Attest:*

*Attesting Officer*

JAMES E. ROGAN
*Director of the United States Patent and Trademark Office*